United States Patent [19]

Tanaka et al.

[11] Patent Number: 4,671,240

[45] Date of Patent: Jun. 9, 1987

[54] FUEL INJECTION SYSTEM FOR AN INTERNAL COMBUSTION ENGINE

[75] Inventors: Kenzi Tanaka; Koichi Gomi; Tamotsu Fukuda; Masataka Hayashi, all of Toyota, Japan

[73] Assignee: Toyota Jidosha Kabushiki Kaisha, Toyota, Japan

[21] Appl. No.: 824,109

[22] Filed: Jan. 30, 1986

[30] Foreign Application Priority Data

Jan. 31, 1985 [JP] Japan ..... 60-15401

[51] Int. Cl.[4] ..... F02M 17/00

[52] U.S. Cl. ..... 123/463; 123/179 L

[58] Field of Search ..... 123/463, 510, 512, 464, 123/179 L

[56] References Cited

U.S. PATENT DOCUMENTS

| | | | |
|---|---|---|---|
| 3,487,820 | 1/1970 | Clark | 123/463 |
| 4,404,944 | 9/1983 | Yamazaki et al. | 123/463 |
| 4,481,926 | 11/1984 | Miki | 123/463 |
| 4,539,960 | 9/1985 | Cowles | 123/463 |

FOREIGN PATENT DOCUMENTS

| | | | |
|---|---|---|---|
| 55-106359 | 7/1980 | Japan | 123/179 L |
| 55-116876 | 8/1980 | Japan | 123/179 L |
| 57-193965 | 12/1982 | Japan | 123/179 L |
| 58-67964 | 4/1983 | Japan | 123/179 L |
| 58-131356 | 8/1983 | Japan | 123/179 L |

*Primary Examiner*—Ronald B. Cox

*Attorney, Agent, or Firm*—Finnegan, Henderson, Farabow, Garrett & Dunner

[57] ABSTRACT

A fuel injection type internal combustion engine provided with a pressure regulator for controlling a constant difference between a pressure of fuel supplied to the injector and a pressure of the intake system at the position where the injector is mounted. A tank is arranged for storing a positive pressure obtained while the engine is operated. A switching valve is arranged for connecting the tank with the pressure regulator when the engine is started when hot. Due to the operation of the regulator for maintaining the constant pressure difference, the pressure of the fuel supplied to the fuel injector is increased, making it difficult for the fuel to vaporize. Thus, preventing a so-called vapor lock.

8 Claims, 17 Drawing Figures

Fig.2(a) IGNITION KEY SWITCH 82

Fig.2(b) STARTER

Fig.2(c) FUEL TEMPERATURE

Fig.2(d) FUEL TEMPERATURE SWITCH

Fig.2(e) VSV

Fig.2(i) TIME

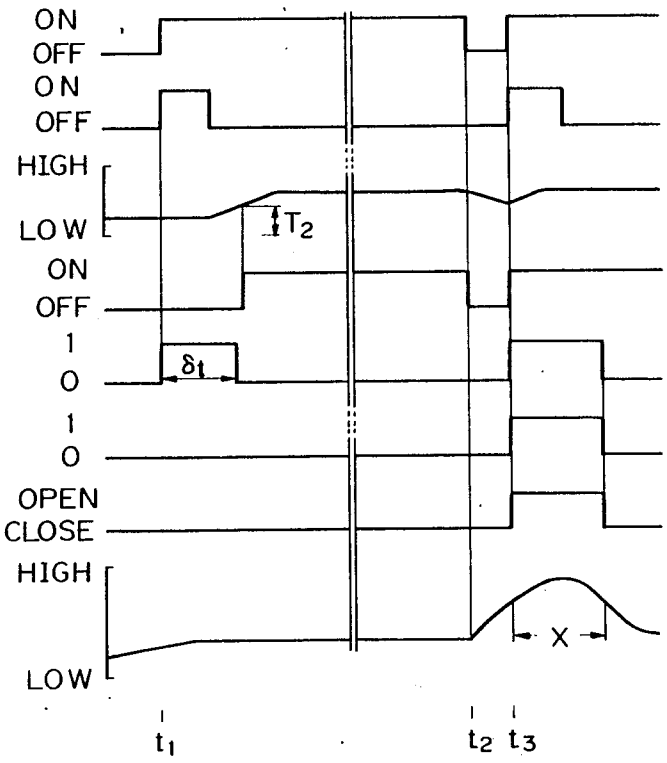
Fig. 4(a) IGNITION KEY SWITCH 82
Fig. 4(b) STARTER
Fig. 4(c) WATER TEMPERATURE
Fig. 4(d) WATER TEMPERATURE SWITCH
Fig. 4(e) MSU
Fig. 4(f) AND
Fig. 4(g) VSV
Fig. 4(h) FUEL TEMPERATURE SWITCH
Fig. 4(i) TIME

FUEL INJECTION SYSTEM FOR AN INTERNAL COMBUSTION ENGINE

BACKGROUND OF THE INVENTION

1. Field of the Invention

The present invention relates to a fuel injection type internal combustion engine provided with a pressure regulating device for maintaining a constant pressure difference between an inlet and outlet of a fuel injector.

2. Description of the Related Art

Known in the prior art is an electronic controlled fuel injection type internal combustion engine provided with a pressure control system for maintaining a constant pressure difference between the inlet and outlet of a fuel injector. In the electronic controlled fuel injection internal combustion engine, the amount of fuel to be injected is calculated in accordance with various engine operating conditions, and the injector is operated for a period allowing the calculated amount of fuel to be injected. The amount of fuel actually injected is, however, varied with the constant period of the operation of the fuel injector when the pressure difference between the inlet and outlet of the fuel injector is varied. Therefore a constant pressure difference must be maintained in order to obtain a precise control of the amount of the fuel to be injected.

A system has been proposed for maintaining a constant pressure difference wherein a pressure regulator is provided having a diaphragm which is operated by a pressure difference between a pressure of fuel from a fuel supply pump and a pressure of an engine intake line at a position where the fuel injector is mounted.

When the engine is started the opening of the throttle valve is small, so that the intake pressure in the sense of absolute pressure is small. As a result, the regulator system operates so that the pressure of the fuel supplied to the injector from the fuel pump is correspondingly decreased. The decreased pressure of the fuel causes the fuel to be vaporized in the fuel passageway when the engine is in a condition where the temperature of the fuel is high. Such a high temperature of the fuel will be generated in a situation such as that wherein the engine is stopped for a short while after high speed operation and then restarted. Due to the vaporization of fuel in the fuel passageway leading to the fuel injector, a so-called "vapor lock" is generated, causing difficulty in introducing the fuel into the fuel injector, making it difficult to easily start the engine.

To overcome this difficulty, a system is proposed wherein a detecting means is provided for detecting the condition of the high temperature of the engine to be started, and the detecting signal is supplied to the pressure regulator, thus opening the pressure regulator to the atmospheric pressure and cancelling the operation thereof. However, in this improved art, when the operation of the pressure regulator is cancelled, the pressure obtained in the regulator is at most atmospheric pressure, which is insufficient to allow the engine to be easily started. This also leads to an unstable idling operation.

SUMMARY OF THE INVENTION

The object of the present invention is to provide a pressure regulator system capable of overcoming the above mentioned difficulty.

According to the present invention, a fuel injection system is provided for an internal combustion engine having an intake line in which a throttle valve is arranged, the system comprising: a fuel injector arranged in the intake line downstream of the throttle valve for injecting an amount of fuel to the engine; a fuel pump for generating a forced flow of fuel; a fuel conduit for supplying the fuel from the fuel pump to the fuel injector, this fuel injector being connected to the fuel conduit; a regulator means for controlling the pressure of the fuel supplied from the fuel pump to the fuel injector, so that a constant difference is maintained between a pressure of the fuel from the fuel pump and a pressure of the intake line adjacent to the injector; a positive pressure source connected to the engine; storing means for storing the positive pressure obtained at the positive pressure source during the operation of the engine; switching means for switching the connection of the regulator means between the intake line downstream of the throttle valve and the storing means; and, means for detecting the condition of the engine where the engine has just been started when hot, so that the switching means is switched from a normal condition at which the regulator means is connected to the intake line to a condition at which the regulator means is connected to the storing means.

DESCRIPTION OF THE PREFERRED EMBODIMENTS

Figure 1:
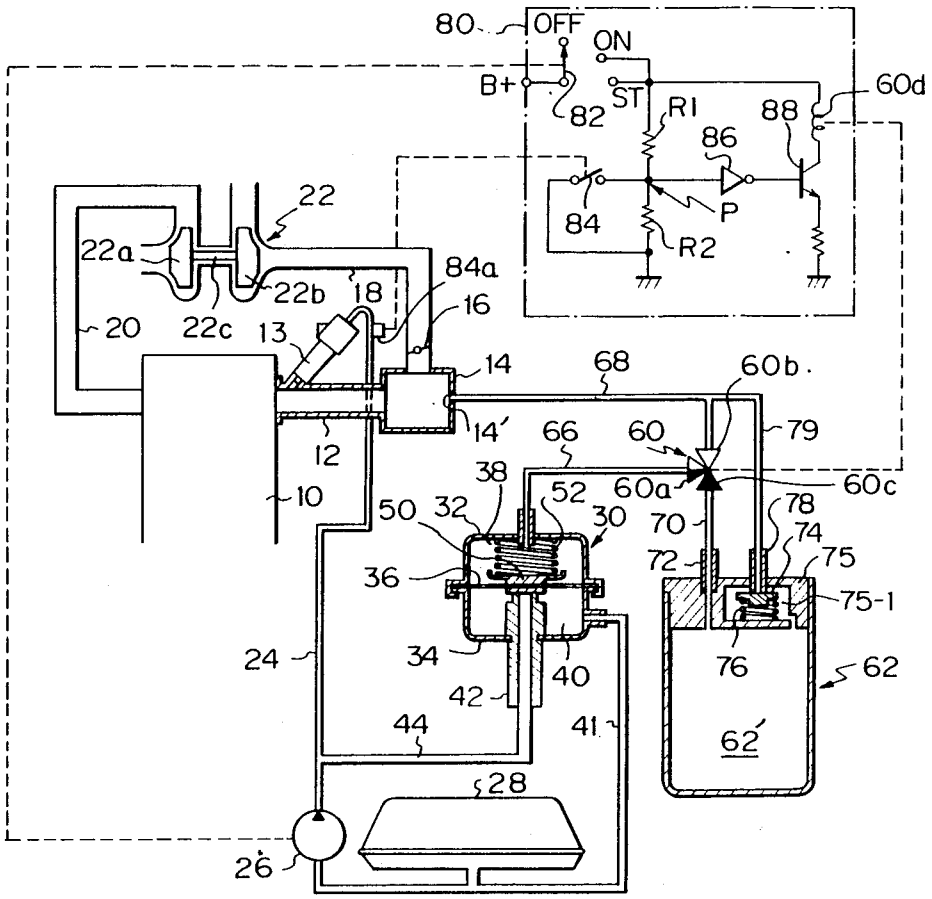
FIG. 1 is a general schematic view of the system according to an embodiment of the present invention.

FIG. 1 indicates an embodiment of the pressure regulator system according to the present invention for a fuel injection type internal combustion engine provided with a turbocharger. In FIG. 1, reference numeral 10 denotes an engine body, 12 an intake manifold, 13 a fuel injector, 14 a surge tank, 16 a throttle valve, 18 an intake pipe, and 20 an exhaust pipe.

The turbocharger 22 has a turbine wheel 22*a* in fluid connection with the exhaust pipe 20, a compressor wheel 22*b* in fluid connection with the intake pipe 18, and a rotating shaft 22*c* mechanically connecting together the turbine wheel 22*a* and the compressor wheel 22*b*.

The fuel injector 13 is connected, via a fuel passageway 24 and a fuel pump 26, to a fuel tank 28. The fuel from the fuel pump 26 is supplied in a pressurized condition to the fuel injector 13. As is well known to those skilled in the art, the fuel injector 13 is operated by an electronic control unit (not shown) in such a manner that a calculated amount of fuel is injected from the injector 13.

A pressure regulator 30 is adapted for maintaining a constant pressure difference between the inlet and the outlet of the fuel injector 13. The pressure regulator 30 is provided with casings 32 and 34 between which a diaphragm 36 is arranged so that an air pressure chamber 38 and a fuel chamber 40 are formed on each side of the diaphragm, respectively. A fuel return pipe 41 is connected at one end to the fuel chamber 41, and at the other end to the fuel tank 28. A pump pressure induction pipe 42 is connected to the bottom case 34 so that the pipe 42 is selectively opened or closed to the fuel chamber 40 by means of a valve member 50 connected to the diaphragm 36 at the center thereof. A spring 52 is arranged in the air pressure chamber 38 so that the valve member 50 is urged downwardly, as explained in FIG. 1, so that the valve member 50 is seated on, and thereby closes, the end of the fuel pressure induction pipe 42.

According to the present invention, a mechanism is provided for detecting whether or not the engine is started when hot, and for providing an accumulated positive pressure or an intake pressure, respectively, to the control chamber 38. The mechanism is essentially constructed by a fluid switching valve 60 and a pressure accumulating tank 62. The switching valve 60 has a common port 60*a*, and first and second switching ports 60*b* and 60*c*. The common port 60*a* is connected to the pressure control chamber 38 of the pressure regulator 30 via a pipe 66. The first switching port 60*b* is connected, via a pipe 68, to a pressure taking-out port 14' of the surge tank 14. The second switching port 60*c* is connected, via a pipe 70, to a union 72 mounted at the upper end of a pressure accumulating chamber 62. The union 72 is opened to a space 62' formed inside the tank 62. A check valve 74 is arranged in a recess 75-1 formed in a plug 75 fixedly inserted into the open end of the tank 62. A spring 76 is arranged in the recess 75-1 so that the check valve 74 is seated on a union 78 also mounted at the plug 75. The check valve 74 is adapted for maintaining a positive pressure in the tank 62. The union 78 is connected, via a pipe 79, to the surge tank 14.

Reference numeral 80 denotes a control circuit in accordance with the present invention for operating the switching valve 60 when the engine is started when hot. The control circuit 80 is provided with a switch 82 which is itself an ignition key switch or a switch synchronously operated with the engine ignition switch, a thermoswitch 84 operated in accordance with the temperature of the fuel received by the fuel injector 13, an inverter 86, and a transistor 88. A solenoid 60*d* of the switching valve 60 is connected at one end to the emitter-to-collector circuit of the transistor 68. The other end of the solenoid 60*d* is connected to ON and ST (starter) terminals of the switch 82. The transistor 88 has a base connected, via the inverter 86, to a voltage divider comprised of resistance elements R1 and R2, which are connected in series to the ON and ST terminals of the switch 82. The dividing point p of the divider is connected to the earth via the thermoswitch 84. The thermoswitch 84 is provided with a temperature sensing portion 84*a* in contact with the fuel in the fuel passageway 24 at a position near the fuel injector 13. The switch 82 has a line, shown in the figure by a dotted line, for operating the fuel pump 26.

Figure 2:
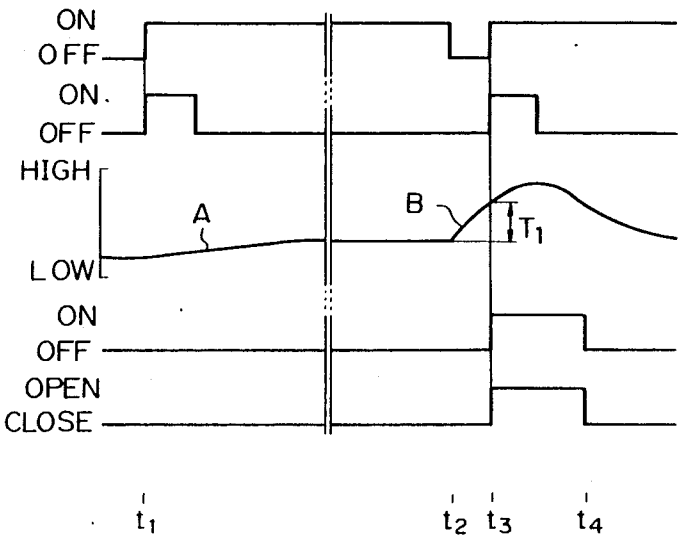
FIGS. 2*a–i* show timing charts explaining the operation of the embodiment shown in FIG. 1.

The operation of the above mentioned system is described below. When the engine is to be started at time $t_1$ in FIG. 2-(*a*), the ignition key switch 82 is first moved to the ON position and then to the ST position. Thus, the starter begins to rotate (FIG. 2-(*b*)). If the engine has been stopped for a prolonged time, a low temperature of the fuel is detected by the sensor portion 84*a*. The temperature of the fuel gradually increases in accordance with the lapse of time, as shown by a line A in FIG. 2-(*c*), during which time the temperature switch 84 is maintained OFF, as shown in FIG. 2-(*d*), bringing the dividing point p to a high level. Thus a low signal is applied, via the inverter 86, to the base of the transistor 88. As a result, the transistor 88 is cut-off and thus the solenoid 60*d* is deenergized. Thus the switching valve 60 assumes a position (below, closed position) at which the common port 60 is in communication with the first switching port 60*b*, so that the pressure control chamber 38 of the regulator 30 is opened to the pressure taking-out port 14' of the surge tank 14. As a result, the diaphragm 36 is operated by the pressure difference between a fuel supply pressure in the lower chamber 40 connected to the fuel pipe 24 and an intake pressure in the upper chamber 38 connected to the surge tank 14. When the pressure difference is large enough to overcome the force of the spring 52, the diaphragm 36 moves upward to lift the valve member 50 from the seat of the fuel pressure induction pipe 42, allowing the fuel to be introduced into the chamber 40. Thus, a part of the fuel from the pump 26 is diverted, via the pipes 44 and 42, the chamber 40, and the fuel return pipe 41, to the fuel tank 28, causing the pressure in the chamber 40 to be decreased. As a result, the pressure difference between the chamber 38 and 40 becomes small enough to allow the spring 52 to move the valve member 50 downward and close the fuel induction pipe 42. As a result, diversion of the fuel to the return pipe 41 is stopped, causing the pressure in the chamber 40 to be again increased. Due to such repeated open and close operations, the pressure difference across the diaphragm 36, i.e., the pressure difference between the inlet and outlet of the fuel injector 13 is maintained at a constant value determined by the force of the spring 52 of the regulator 30. As a result, an advantage is obtained in that the amount of fuel to be injected from the injector 13 is made independent of the pressure of fuel supplied from the fuel pump 26, which is varied in accordance with the engine operating conditions.

During the operation of the engine, the turbocharger 22 reaches a supercharging operation when the engine is under a full load condition wherein the throttle valve 16 is wide open. In this situation, the turbine wheel 22*a* is rotated by the energy of the exhaust gas and rotates the compressor 22*b*, permitting the intake air in the intake pipe 18 to be compressed, and thus obtaining a high engine output power. Due to this operation of the turbocharger 22, a positive pressure is created in the intake pipe 18 downstream of the turbocharger 22. This positive pressure causes the check valve 74 to open against the force of the spring 76, so that the space 62' inside the tank 62 has the same positive pressure. This positive pressure is maintained even if the operation of the turbocharger 22 is stopped during the partial load condition of the engine, wherein the throttle valve 16 is closed to create the vacuum pressure in the surge tank 14, because on one hand, the spring 76 urges the check valve 74 to a closed position, and on the other hand, the switching valve 60 is maintained in the closed position at which the second switching port 60*c* opened to the accumulator tank 62 is blocked.

The ignition key switch 82 is made OFF when the engine is stopped at time $t_2$ in FIG. 2. At this instant, the temperature of the fuel detected by the sensor portion 84*a* of the thermoswitch 84 increases, as shown by the line B in FIG. 2-(*c*), because on one hand, the engine is still hot, and on the other hand, the engine cooling operation by the rotation of a fan as well as the vehicle movement cannot be obtained. When the ignition key switch is made ON and then ST during the period wherein the temperature of the fuel is increasing at the time $t_3$, the thermoswitch 84 is automatically made ON, as shown by FIG. 2-(*d*), because the temperature of the fuel detected by the sensor portion 84*a* of the switch exceeds a predetermined level $T_1$, which corresponds to the lowest value of the fuel temperature at which the engine will become difficult to operate or start. The ON position of the switch 84 causes the dividing point p to be earthed to provide a low level signal, and accordingly, a high level signal is applied, via the inverter 86, to the base of the transistor 88, causing the transistor 88 to be made ON. Thus, the solenoid 60*d* of the switching valve 60 is energized, to reach a position (below, open position) at which the common port 60*a* is connected to the second switching port 60*c*, so that the air pressure control chamber 38 is opened to the accumulator 62. As a result, the chamber 38 attains the same positive pressure maintained in the accumulator 62 during the supercharging condition of the engine. The positive pressure in the chamber 38 increases the pressure in the fuel chamber 40 correspondingly, as a result of operation of the pressure regulator 30 for maintaining a constant pressure difference between the chambers 38 and 40. As a result of the increase in the pressure in the fuel pressure chamber 40 of the pressure regulator 30, the pressure of the fuel directed to the fuel injector 13 from the fuel pump is correspondingly increased so that the fuel in the passage 24 becomes difficult to vaporize, preventing an occurrence of the so-called vapor lock, and therefore the engine becomes easy to start and operate.

After a sufficient time has elapsed after the engine has started, the temperature of the fuel sensed by the sensing portion 84*a* of the thermoswitch 84 is decreased below the predetermined level $T_1$, so that the thermoswitch 84 is made OFF. Thus, the switching valve 60 is switched to the closed condition, as shown in FIG. 2-(*e*), so that the air pressure chamber 38 is connected to the intake air pressure take-out port 14', allowing the pressure regulator 30 to carry out the normal operation for maintaining the constant pressure difference between the inlet and the outlet of the fuel injector 13.

Figure 3:
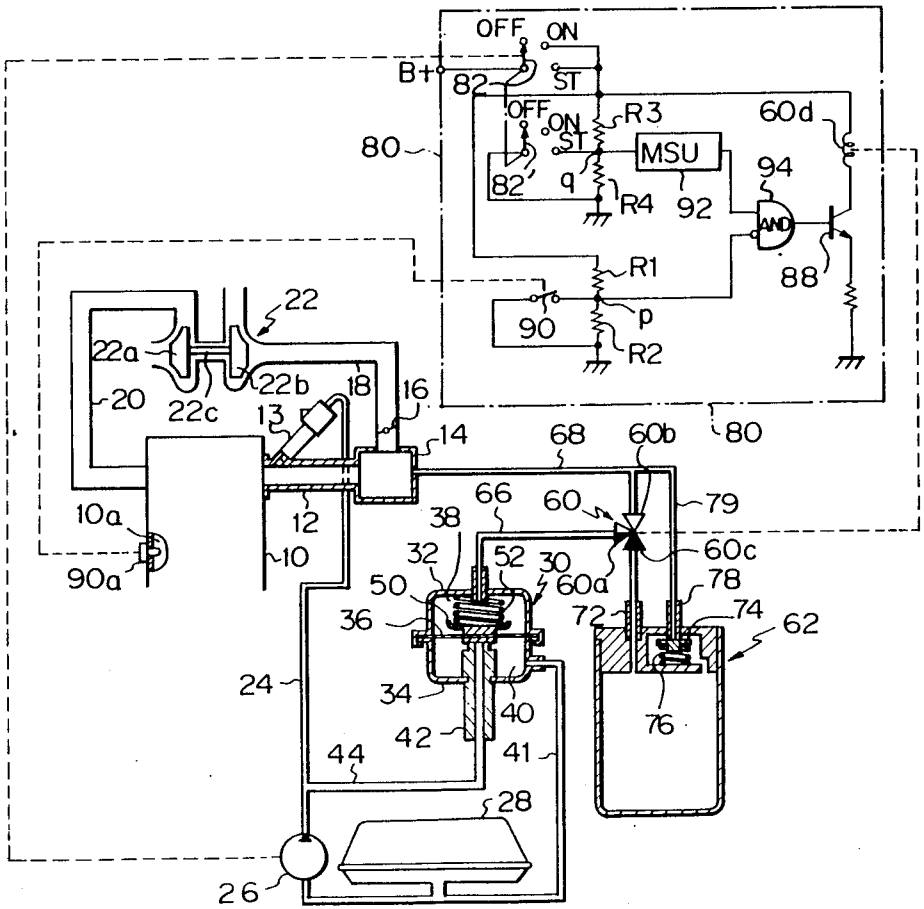
FIG. 3 is a general schematic view of the system according to a second embodiment of the present invention; and, FIGS. 4*a–i* show timing charts explaining the operation of the second embodiment shown in FIG. 3.

FIG. 3 shows another embodiment which differs from the first embodiment in FIG. 1 in that a temperature switch 90 is provided having a sensor portion 90*a* for detecting the temperature of the engine cooling water housed in a water jacket 10*a* of the engine body 10. The control circuit 80 is provided with a monostable unit 92 and an AND gate 94. The AND gate 94 has a inverted input connected to the dividing point p of the voltage divider ($R_1$ and $R_2$), and a non-inverted input connected, via the monostable unit 92, to the dividing point q of another voltage divider comprised of resistors $R_3$ and $R_4$, which are connected in series to the battery. The dividing point q is connected to earth via an ST terminal of a switch 82' cooperating with the ignition key switch 82. The other construction of this embodiment is the same as that of the first embodiment, and therefore, a detailed description thereof is omitted by applying the same reference numbers to parts attaining the same operation.

The operation of the second embodiment will now be described. When the engine is started at the time $t_1$ in FIG. 4, in addition to the ignition key switch 82, the switch 82' cooperating therewith is moved to the ST terminal, allowing the monostable unit 92 to be triggered, and providing a high level signal "1" for a predetermined period $\delta_t$, as shown in FIG. 4-(*e*). When the engine is cold, the temperature of the engine coolant detected by the sensor portion 90*a* of the thermoswitch 90 is lower than a predetermined value $T_2$, so as to maintain the OFF position as shown in FIG. 4-(*d*). As a result, the AND gate 94 issues a low level signal (f), causing the transistor 88 to be cut OFF. Accordingly, the solenoid 60*d* is de-energized, thus closing the switching valve 24. Therefore, as in the first embodiment, a normal operation of the pressure regulator 30 is obtained.

During the operation of the engine, the temperature of the engine coolant in the water jacket 10*a* sensed by the sensor portion 90*a* changes, as shown by FIG. 2-(*c*), and attains a constant value when a predetermined period has elapsed after the start of the engine. During the normal operation period of the engine, a positive pressure is maintained in the accumulator tank 62.

At the time $t_2$, the ignition key switch 82 is made OFF in order to stop the engine. After a short time has elapsed, the engine is again started at the time $t_3$. In this case, the temperature of the fuel is, as already explained in reference to the first embodiment, extremely increased as shown in FIG. 2-(*h*), during which period the engine cooling water is substantially maintained at a temperature higher than the predetermined level $T_2$, causing the thermoswitch 90 to be made ON as shown in FIG. 4-(*d*). Thus, the inverted input of the AND gate 94 becomes low. Since the switch 82' cooperating with the ignition key switch 82 is switched to the ST position, the monostable unit 92 issues a high level signal at the output thereof, which is transmitted to the non-inverted input of the AND gate 94. Thus, the AND gate 94 issues a high level signal (FIG. 4-(*f*)) which is transmitted to the base of the transistor 88, to make it ON. As a result, the solenoid 60*d* is energized and assumes the open position as shown in FIG. 4-(*h*). Thus, the accumulator tank 62, in which the positive pressure is stored, is opened to the air chamber 38 of the pressure regulator 30. Thus, the pressure of the fuel from the fuel pump to the fuel injector 13 is increased by the same principle as described with reference to the first embodiment.

When a predetermined time $\delta_t$ has elapsed, the monostable unit 92 issues a low level signal, so that the condition of the AND gate 94 is changed to a low state, causing the transistor 88 to be made OFF. Thus, the switching valve 60 is moved to the closed position, at which the air pressure control chamber 38 is connected to the surge tank of the engine, so that the normal operation of the pressure regulator 30 is attained. It should be noted that the time $\delta_t$ for issuing the high level signal is determined by considering the period X in FIG. 4-(*h*), wherein the engine is in a condition in which it is difficult to start.

Although the above mentioned first and the second embodiments are both directed to a turbocharger engine capable of attaining a positive pressure in the intake passageway of the engine, the present invention can, of course, be equally applied to an internal combustion engine provided with a mechanical supercharger.

The difficulty of starting a hot engine also arises in a high rotational speed type engine without a supercharger. In this type of engine, the intake line of the engine does not produce a positive pressure. Therefore, the pressure accumulator tank is connected to a separate positive pressure source, such as an air injection pump operated by the engine, well known per se, for maintaining a positive pressure in the tank 62. In this case, instead of connecting the pipe 79 in FIG. 1 or 3 to the surge tank 14, the pipe 79 is connected to an outlet of the air pump.

Although the invention is described with reference to the preferred embodiments, many modification and changes can be made by those skilled in this art without departing from the scope and spirit of the present invention.

We claim:

1. A fuel injection system for an internal combustion engine having an intake line in which a throttle valve is arranged, said system comprising:

a fuel injector arranged in said intake line downstream of said throttle valve for injecting an amount of fuel to the engine;

a fuel pump for generating a forced flow of fuel;

a fuel conduit for supplying fuel from said fuel pump to said fuel injector, said fuel injector being connected to said fuel conduit;

regulator means for controlling a pressure of fuel supplied from said fuel pump to said fuel injector, so that a constant difference is maintained between a pressure of fuel from said fuel pump and a pressure of said intake line adjacent to said fuel injector;

a positive pressure source connected to the engine;

storing means for storing a positive pressure obtained at said positive pressure source during operation of the engine;

switching means for switching connection of said regulator means between said intake line downstream of said throttle valve and said storing means; and, means for detecting a condition of the engine wherein the engine has just been started when hot, so that said switching means is switched from a normal condition wherein said regulator means is connected to said intake line to a condition wherein said regulator means is connected to said storing means.

2. A system according to claim 1, wherein said regulator means comprise a diaphragm, a first chamber formed on one side of said diaphragm, said first chamber being in communication with said fuel conduit upstream of said fuel pump, a second chamber formed on an other side of said diaphragm, said second chamber being in communication with said intake line via said switching means, spring biased valve means responsive to a pressure difference between said first and said second chambers for controlling connection of said first chamber to said fuel conduit downstream of said fuel pump.

3. A system according to claim 2, wherein said valve means comprise a valve member connected to said diaphragm, a fuel pressure inlet, one end of which is in face-to-face contact with said valve member, and another end of which is connected to said fuel conduit between said fuel pump and said fuel injector, and a spring arranged in said second chamber for urging said diaphragm so that said valve member closes said fuel pressure inlet.

4. A system according to claim 1, wherein said storing means comprise a tank in which a positive pressure is stored, means for allowing one way transmission of a positive pressure in the positive pressure source when the engine is operated, and a conduit for connecting said tank with said switching means.

5. A system according to claim 4, wherein said one way transmission means comprise a positive pressure inlet connected to said positive pressure source, and a spring biased valve member for urging said positive pressure inlet closed, said valve member being opened by a positive pressure from said positive pressure source.

6. A system according to claim 1, wherein said detecting means comprise a sensor for detecting a high temperature of fuel supplied to said fuel injector.

7. A system according to claim 1, wherein said detecting means comprise a sensor for detecting a high temperature of the engine cooling water, a timer means for detecting a predetermined short period from the start of the engine, and a gate means for changing a state thereof when said engine cooling water temperature is high during start of the engine.

8. A system according to claim 1, wherein said engine is provided with a supercharger, said positive pressure source being the intake line downstream of the supercharger.

* * * * *